United States Patent [19]

Yasumoto et al.

[11] 3,994,137

[45] Nov. 30, 1976

[54] METHOD OF AND DEVICE FOR CONTROLLING A REHEATING STEAM TURBINE PLANT

[75] Inventors: Akihiro Yasumoto; Satoshi Ninomiya, both of Hitachi, Japan

[73] Assignee: Hitachi, Ltd., Japan

[22] Filed: May 14, 1974

[21] Appl. No.: 469,844

[30] Foreign Application Priority Data

May 14, 1973 Japan ..... 48-52492

[52] U.S. Cl. ..... 60/663; 60/679

[51] Int. Cl.[2] ..... F01K 13/02

[58] Field of Search ..... 60/652, 646, 677, 679, 60/662, 663

[56] References Cited

UNITED STATES PATENTS

| | | | |
|---|---|---|---|
| 3,205,664 | 9/1965 | Nettel | 60/646 |
| 3,264,826 | 8/1966 | Kane et al. | 60/679 |
| 3,359,732 | 12/1967 | Schuetzenduebel | 60/646 |
| 3,488,961 | 1/1970 | Gerber | 60/652 |
| 3,545,207 | 12/1970 | Barber et al. | 60/664 |

*Primary Examiner*—Allen M. Ostrager
*Attorney, Agent, or Firm*—Craig & Antonelli

[57] ABSTRACT

Improvements in or relating to a reheating steam plant comprising a main steam line connecting a heater to a higher pressure turbine through regulating valves, and a reheated steam line connecting the higher pressure turbine to an intermediate pressure turbine through a reheater, a reheating stop valve and an intermediate stop valve. The improvements consist in the provision of a branch line branching off from the main steam line at a point disposed on the up-stream side of the regulating valves and connected to the reheated steam line at a point interposed between the intermediate stop valve and the intermediate pressure turbine, an adjusting valve mounted in the branching line, and a control for the adjusting valve. The adjusting valve is adapted to be opened when the turbine is under an overload so as to introduce to the intermediate pressure turbine a portion of the steam supplied from the heater.

12 Claims, 2 Drawing Figures

METHOD OF AND DEVICE FOR CONTROLLING A REHEATING STEAM TURBINE PLANT

BACKGROUND OF THE INVENTION

This invention relates to a steam turbine plant and an atomic power turbine plant of the reheating system.

There has in recent years been an increasing demand for turbine plants of high efficiency which are required to operate under a rated load when performing a normal operation with the regulating valves being fully open, and to operate under an overload when the output power has reached its peak.

In order to meet this demand, proposals have been made to increase the number of regulating valves and use some of them as valves to be actuated when an overload is applied to the turbine means. This arrangement has, however, a disadvantage in that the operation of the turbine means is low in efficiency when all the valves including those for operating the turbine means under an overload are fully opened, because the turbine means of this type is designed such that its operation efficiency reaches a highest level when the regulating valves are fully open or when partial injection of stream is effected.

SUMMARY OF THE INVENTION

This invention has as its object the provision of a method of and a device for controlling a steam turbine plant of the reheating system which permits the turbine means of the plant to operate with a high degree of efficiency when the turbine means operates under an overload after the output power has reached its peak.

The outstanding characteristic of the invention will first be summarized. According to the invention, means is provided, in a reheating steam turbine plant which is operated by supplying steam from the heater to a higher pressure turbine and steam from the reheater to an intermediate pressure turbine, for operating the turbine means by adding a portion of the steam from the heater to the steam from the reheater and supplying the same to the intermediate pressure turbine when the turbine means operates under an overload after the output power has reached its peak. The advantage obtained by this arrangement is that the turbine means can be operated under an overload while maintaining the operation efficiency of the higher pressure turbine at a highest level, thereby permitting the reheating steam turbine plant as a whole to operate with a high degree of efficiency when placed under an overload.

Additional and other objects and features of the invention will become evident from the description set forth hereinafter when considered in conjunction with the accompanying drawings.

DESCRIPTION OF A PREFERRED EMBODIMENT

Figure 1:
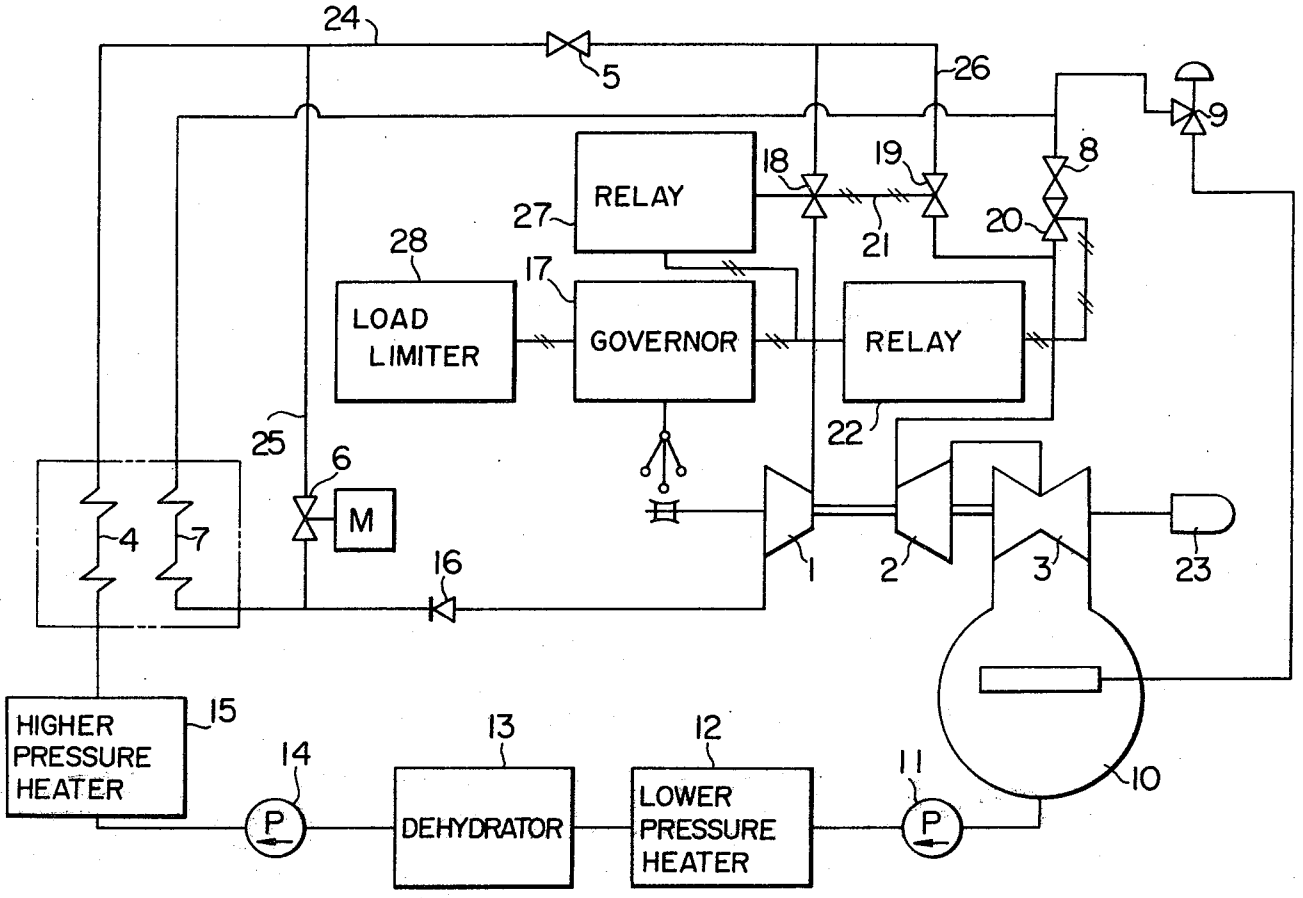
FIG. 1 is a diagrammatic representation of an embodiment of the reheating steam turbine plant according to the invention.

FIG. 1 shows the present invention as being incorporated in a reheating steam turbine plant comprising a steam passageway which bypasses the higher pressure turbine, intermediate pressure turbine and lower pressure turbine. The invention has particular utility in this type of reheating steam turbine plants which enable the time required for start-up to be reduced and permit the boiler to be operated in readiness for reopening of operation when the turbine means is tripped, in view of the fact that the control device according to the invention is easy to fabricate. The invention will now be described in detail with reference to its embodiment shown in FIG. 1.

In FIG. 1, the steam generated in a heater 4 passes through a main steam line 24 in which a main stop valve 5 and regulating valves 18 are mounted, and is introduced into a higher pressure turbine 1. The exhaust steam discharged from the higher pressure turbine 1 is reheated in a reheater 7 and supplied to an intermediate pressure turbine 2 through a reheated steam top valve 8 and an intermediate stop valve 20. The steam thus introduced into the intermediate pressure turbine 2 is passed on, through a lower pressure turbine 3, to a condenser 10 for operating the generator 23. A conduit branches off from the line supplying the steam from the reheater 7 to the intermediate pressure steam turbine 2 at a point anterior to the reheated steam stop valve 8, and is connected to the condenser 10 through a spill-over valve 9.

The steam is changed to a liquid state in the condenser 10, and the water is supplied to the heater 4 through a condenser pump 11, a lower pressure heater 12, a dehydrator 13, a water supply pump 14 and a higher pressure heater 15. In order to hasten the start-up of the turbine means, a bypass line 25 branches off from the main steam line 24 at a point disposed anterior to the main stop valve 5, and is connected to a line connecting the higher pressure turbine 1 to the reheater 7. A steam converting valve 6 is mounted in the bypass line 25 to control the flow rate of steam therethrough. A higher pressure steam discharge check valve 16 is mounted in the line connecting the higher pressure turbine 1 to the reheater 7 so as to preclude introduction into the higher pressure turbine 1 the steam which moves through the bypass line 25 to the reheater 7. There is provided a governor 17 for controlling the degree of opening of the regulating valves 18 and the intermediate stop valve 20.

According to the invention, there are provided, in the reheating steam turbine plant constructed as aforementioned, a branch line 26 which branches off from the main steam line 24 at a point interposed between the main stop valve 5 and the regulating valves 18 and leads to the line connecting the intermediate stop valve 20 to the intermediate pressure turbine 2, and an adjusting valve 19 mounted in the branch line 26 for controlling the flow rate of steam therethrough. The adjusting valve 19 is connected to the regulating valves 18 by a mechanical or electric cam 21 which is coaxial therewith. The cam 21 is operated by a load limiter 28 at light loads and by the governor 17 through a relay 27 at a rated load and when the load is close to an overload, so that the opening and closing of the regulating valves 18 and adjusting valve 19 can be controlled. The intermediate stop valve 20 is connected through another relay 22 to the governor 17, so that the regulating valves 18, adjusting valve 19 and intermediate stop vlave 20 can all be closed simultaneously when the turbine means is tripped.

The mode of operation of the reheating steam turbine plant constructed as aforementioned will now be described. When the turbine means is to be started up quickly, the steam generated in the heater 4 is under a pressure and at a temperature which are not high enough to be introduced into the turbine means and the main stop valve 5 remains closed, so that the steam is led through the bypass line 25. The steam converting valve 6 is controlled to cause the steam to flow to the reheater 7 and cool the same, in order to prevent heating of the reheater 7 be the heater 4. The steam that has moved through the reheater 7 is led to the condenser 10 through the spill-over valve 9 because the reheated steam stop valve 8 is also closed. Stated differently, the steam bypasses the higher pressure turbine 1, intermediate pressure turbine 2 and lower pressure turbine 3 altogether, so that the heat load applied to the boiler can be gradually increased till the steam is introduced to the turbine means.

As soon as the introduction of the steam to the turbine means is begun, the main stop valve 5 and reheated steam stop valve 8 are reset and each brought to a fully open position, and the regulating valves 18 and adjusting valve 19 are gradually opened by the action of the governor 17 so as to increase the turbine speed. The intermediate stop valve 20 is brought to a fully open position after the turbine means has begun to function as a reheating steam turbine system and the operation of the turbine means is put under control. Then, the regulating vlaves 18 are further opened and the adjusting valve 19 is brought to a fully closed position, so that the turbine means begins to operate under a rated load.

In the turbine plant described above, the nozzle at the inlet of the higher pressure turbine and the blades thereof are designed such that control of the load applied to the turbine means in a normal operation can be effected by controlling the regulating valves 18 and the highest efficiency at the inlet of the higher pressure turbine is attained when several regulating valves are each brought to a fully open position. With the control device according to the invention, additional steam of higher pressure from the heater 4 can be introduced to the intermediate pressure turbine 2 by actuating the adjusting valve 19 when the turbine means is placed under an overload after the output power has reached its peak.

Figure 2:
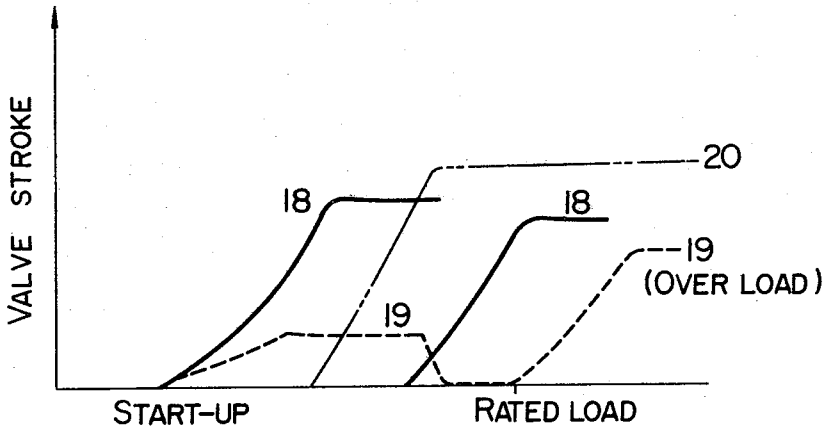
FIG. 2 is a diagram in explanation of the manner of operation of various control valves of the reheating steam turbine plant according to the invention at the time the turbine means is actuated and when it is under an overload.

FIG. 2 is a lift diagram showing the manner of operation of various valves involved in the invention when the turbine speed is increased. It will be noted that there are two valve lifts for the regulating valves 18 in the figure. They represent the regulating valve 18 which opens first and the regulating valve 18 which opens lastly after all the other regulating valves 18 have opened. It is usual practice to provide a plurality of regulating valves in a turbine plant.

In FIG. 2, it will be evident that the regulating valves 18 and the adjusting valve 19 begin to open simultaneously when the turbine plant is started up, with the adjusting valve 19 beginning to close when a load has begun to be applied to the turbine means and the intermediate stop valve 20 is brought to a fully open position. Since the regulating valves 18 and the adjusting valve 19 are inter-connected by the cam 21 of the mechanical type or electric type, it is possible to effect control of the turbine speed and the load applied to the turbine means by means of the single governor 17 without interfering with the operation of the turbine means.

Moreover, when there is the hazard of the load being shut off, the relay 22 for the intermediate stop valve 20 can be actuated so as simultaneously to bring the regulating valves 18, adjusting valve and intermediate stop valve 20 each to a closed position, so that safety can be ensured.

When it is required to apply an overload to the turbine means after the output power has reached its peak, the adjusting valve 19 which has remained fully closed is gradually opened after the last regulating valve 18 is brought to a fully open position. By this arrangement, additional steam can be introduced to the intermediate pressure turbine 2, so that the latter can be placed under an overload.

From the foregoing description, it will be appreciated that the advantage obtained by the invention lies in the provision of a most economical reheating turbine system for a turbine plant which can operate with the highest degree of efficiency (with the regulating valves being fully open) when operating under a rated load and which is required to operate under an overload only when the output power has reached its peak, by applying an overload to the intermediate pressure turbine while maintaining the operation efficiency of the higher pressure turbine at a highest level.

It is to be understood that the principles of the present invention can be incorporated in a turbine plant in which the reheater used is not a boiler as aforementioned but a separator for separating hydroscopic moisture from steam as used in an atomic power turbine plant.

We claim:

1. A method of controlling a steam turbine plant of the reheating system which is operated by supplying steam from a heater to a first turbine of higher pressure and supplying steam exhaust from said first turbine to a second turbine of lower pressure than the first turbine after the steam exhaust is reheated in a reheater, such method consisting in adding a portion of the steam from said heater to the steam supplied from said reheater to said second turbine when the steam turbine plant operates under an overload.

2. A method of controlling a steam turbine plant of the reheating system comprising the steps of causing the steam from a heater to pass through a reheater by bypassing reheating steam turbine means comprising a higher pressure turbine and an intermediate pressure turbine, gradually introducing the steam from said heater to said higher pressure turbine and said intermediate turbine substantially simultaneously as the steam from said heater has reached a condition in which it can be introduced into the turbine means, introducing steam from said reheater together with steam from said heater to said intermediate pressure turbine after the steam turbine means has begun to function as a reheating steam turbine system, suspending the supply of steam from said heater to said intermediate pressure turbine when the flow rate of steam from said reheater to said intermediate pressure turbine has reached a predetermined level, and adding the steam from said heater to the steam from said reheater and supplying the same to the intermediate pressure turbine when an overload is applied to the reheating steam turbine means.

3. In a steam turbine plant of the reheating system comprising a main passageway means connecting a heater to a first turbine through regulating valves, reheated steam passageway means connecting said first turbine to a second turbine through a reheater and an intermediate stop valve, and means for detecting an overload applied to the turbine means, improvements consisting in the provision of a control device for said steam turbine plant of the reheating system comprising branch passageway means branching off from said main steam passageway means at a point disposed on the upstream side of said regulating valves so as to supply to said intermediate pressure turbine a portion of the steam from said heater, and valve means mounted in said branch passageway means for controlling the flow of steam through said branch passageway means in accordance with an overload signal produced by said overload detector means.

4. A control device as claimed in claim 3 wherein said branch passageway means is connected at one end to said main steam passageway means at a point disposed on the upstream side of said regulating valves and at the other end to said reheated steam passageway means at a point disposed on the downstream side of said intermediate stop valve.

5. A control device as claimed in claim 3 wherein said regulating valves and said valve means are interconnected by cam means so as to be driven conjointly in accordance with said overload signal.

6. A control device as claimed in claim 5 wherein said cam means is connected to said intermediate stop valve through relay means whereby said regulating valves, said valve means and said intermediate stop valve can be simultaneously closed.

7. In a steam turbine plant of the reheating system comprising a main steam line connecting a heater of a boiler to a higher pressure turbine through a main steam stop valve and regulating valves, a reheated steam line connecting said higher pressure turbine to an intermediate pressure turbine through a reheater, a reheated steam stop valve and an intermediate stop valve, a condenser connected to said intermediate pressure turbine by conduit means through a lower pressure turbine, a water supply line connecting said condenser to said heater, and governor means for controlling said regulating valves and said intermediate stop valve when said turbine means operates under a rated load and an overload, improvements consisting in the provision of a control device for said steam turbine plant of the reheating system comprising a bypass line connecting said main steam line at a point disposed on the upstream side of said main steam stop valve to said reheated steam line at a point interposed between said intermediate pressure turbine and said reheater, a steam converting valve mounted in said bypass line, a branch line branching off from said main steam line at a point disposed on the upstream side of said regulating valves and connected to said reheated steam line at a point interposed between said intermediate stop valve and said intermediate pressure turbine, a control valve mounted in said branch line and connected to said governor means, and a conduit connecting said reheated steam line at a point interposed between said reheater and said intermediate stop valve to said condenser.

8. In a method of controlling a steam turbine plant of the reheating type, which method includes supplying steam from a heater to a high pressure turbine, supplying steam exhausted from the high pressure turbine to a reheater, and supplying the steam from the reheater to a low pressure turbine, the improvement comprising: detecting an overload of the steam plant, and supplying at least a portion of the steam from the heater to the steam from the reheater immediately before admission to the lower pressure turbine so that the steam supplied to the lower pressure turbine is of substantially the same condition as the steam supplied to the high pressure turbine.

9. A method of controlling a steam turbine plant of a reheating system, which system includes a reheating steam turbine means comprising a high pressure turbine and an intermediate pressure turbine, the method comprising: supplying steam from the heater through a reheater by bypassing the reheating steam turbine means, gradually introducing the steam from the heater to the high pressure turbine and the intermediate turbine substantially simultaneously when the steam from the heater has reached a condition in which it can be introduced into the reheating steam turbine means, introducing steam from the reheater together with steam from the heater into the intermediate pressure turbine after the reheating steam turbine means has begun to function as a reheating steam turbine system, suspending the supply of steam from the heater to the intermediate pressure turbine when the flow rate of steam from the heater to the intermediate pressure turbine has reached a predetermined level, detecting an overload of the steam turbine plant, and supplying at least a portion of the steam from the heater to the steam from the reheater prior to admission to the intermediate pressure turbine when an overload is detected so that the steam supplied to the intermediate pressure turbine is substantially of the same condition as the steam supplied to the high pressure turbine.

10. In a steam turbine plant of the reheating system having a main steam passageway means connecting a heater to a high pressure turbine through regulating valves, reheated steam passageway means connecting the high pressure turbine to an intermediate pressure turbine through a reheater and an intermediate stop valve downstream of the reheater, and means for detecting an overload applied to the turbine means, the improvement comprising: a branch passageway means branching off from said mainstream passageway means at a point disposed between the heater and the regulating valve and communicating with said reheated steam passageway means at a point disposed on the downstream side of the intermediate stop valve for supplying to said intermediate pressure turbine at least a portion of the steam from said heater of substantially the same condition as admitted to the high pressure turbine in addition to the steam supplied to said intermediate turbine from said reheater, and means provided in said branch passageway means for controlling the flow of steam through said branch passageway means in accordance with an overload signal produced by said overload detector means.

11. In a steam turbine plant of the type wherein steam from a heater is fed to a high pressure turbine through a main steam passage provided with a main valve and a regulated valve downstream of the main valve, and wherein the steam exhausted from the high pressure turbine is fed to an intermediate pressure turbine through a reheated steam passage provided with an intermediate stop valve after being reheated at a reheater, the improvement comprising: a branch steam passage means for communicating the main steam passage with the intermediate pressure turbine, an adjusting valve disposed in said branch steam passage means between said main steam passage and said intermediate pressure turbine, said branch steam passage having one end thereof connected to the main steam passage between the main stop valve and the regulating valve, the other end of said branch steam passage means being connected to the reheated steam passage between the intermediate valve and the intermediate pressure turbine, means for providing a control signal indicative of a predetermined condition of the steam turbine plant including a governor means, and cam means operatively connected with the regulating valve and the adjusting valve for conjointly operating the regulating valve and the adjusting valve in response to a signal from the control signal means.

12. A steam turbine plant as defined in claim 11, wherein the intermediate stop valve is connected with the governor means through a relay means so that the regulating valve, the adjusting valve and the intermediate stop valve can be simultaneously closed.

* * * * *